US006520353B2

(12) United States Patent
Fulbright

(10) Patent No.: US 6,520,353 B2
(45) Date of Patent: Feb. 18, 2003

(54) SHELF & BRACKET HAVING SNAP-TOGETHER FIT

(75) Inventor: Eric A. Fulbright, Jonesboro, AR (US)

(73) Assignee: L.A.Darling Company, Paragould, AR (US)

( * ) Notice: Subject to any disclaimer, the term of this patent is extended or adjusted under 35 U.S.C. 154(b) by 0 days.

(21) Appl. No.: 09/851,718

(22) Filed: May 8, 2001

(65) Prior Publication Data

US 2002/0166828 A1 Nov. 14, 2002

(51) Int. Cl.[7] ..... A47F 5/08

(52) U.S. Cl. ..... 211/153; 108/108; 211/135

(58) Field of Search ..... 211/153, 90.01, 211/90.02, 90.04, 186, 149, 135, 72, 192; 248/247, 248, 235, 241, 242, 250, 220.21, 220.22; 312/258–259; 108/99–101, 106–108, 162, 165, 171, 147.11, 147.15–147.17, 152

(56) References Cited

U.S. PATENT DOCUMENTS

| | | | | | |
|---|---|---|---|---|---|
| 1,354,270 | A | | 9/1920 | Wood | |
| 2,438,108 | A | * | 3/1948 | Barler et al. | 211/135 |
| 2,891,680 | A | | 6/1959 | MacAleese | |
| 2,900,085 | A | | 8/1959 | Levy | |
| 3,100,460 | A | * | 8/1963 | McElroy | 108/109 |
| 3,163,132 | A | | 12/1964 | Nelson | |
| 3,255,722 | A | * | 6/1966 | Ferdinand et al. | 108/107 |
| 3,556,306 | A | * | 1/1971 | Shell | 108/108 |
| 3,643,607 | A | | 2/1972 | MacKenzie | |
| 3,648,626 | A | | 3/1972 | Schuster | |
| 3,677,202 | A | | 7/1972 | Young | |
| 3,698,329 | A | * | 10/1972 | Diamond et al. | 108/40 |
| 3,765,344 | A | * | 10/1973 | Ferdinand et al. | 108/102 |
| 3,832,957 | A | * | 9/1974 | Mendenhall | 108/108 |
| 3,871,726 | A | * | 3/1975 | Stegner | 108/157.14 |
| 3,984,077 | A | | 10/1976 | Shine | |
| 3,986,616 | A | | 10/1976 | Gray | |
| 3,994,462 | A | | 11/1976 | Shine | |
| 4,296,982 | A | * | 10/1981 | Kullander | 211/135 |
| 4,381,715 | A | | 5/1983 | Forman | |
| 4,624,376 | A | | 11/1986 | Bertram | |
| 4,709,642 | A | * | 12/1987 | Briosi | 108/187 |
| 4,711,183 | A | * | 12/1987 | Handler et al. | 108/107 |
| 4,742,925 | A | * | 5/1988 | Henderson | 108/180 |
| 4,938,442 | A | * | 7/1990 | Mastrodicasa | 108/6 |
| 5,022,529 | A | * | 6/1991 | Kang | 206/581 |
| 5,076,177 | A | * | 12/1991 | Chien | 108/107 |
| 5,405,114 | A | | 4/1995 | Dias | |
| 5,735,221 | A | * | 4/1998 | Benayon | 108/107 |
| 5,738,320 | A | * | 4/1998 | Matos et al. | 108/1 |
| 5,799,803 | A | | 9/1998 | Muller | |
| 5,921,411 | A | * | 7/1999 | Merl | 108/108 |
| 6,019,331 | A | * | 2/2000 | Hoogland et al. | 108/108 |
| 6,021,908 | A | * | 2/2000 | Mathews | 211/153 |
| 6,050,428 | A | * | 4/2000 | Hollander | 211/135 |
| 6,234,328 | B1 | * | 5/2001 | Mason | 211/90.02 |

* cited by examiner

*Primary Examiner*—Daniel P. Stodola
*Assistant Examiner*—Jennifer E. Novosad
(74) *Attorney, Agent, or Firm*—Piper Rudnick

(57) ABSTRACT

A shelf system having a shelf and a bracket. The bracket and shelf interlock to form a snap together unit. The shelf has a channel formed along each of its lateral edges, and each channel extends from the front to the rear of the shelf. The channel is downwardly facing. A tab is lanced out of the side wall of the shelf, and positioned within the channel to form an interference member. A whole is punched in the bracket to cooperate with the tab and the webbed material between the hole and the upper edge of the bracket interferes with the tab, thereby preventing removal of the bracket from the channel after the bracket is assembled to the shelf. The side wall of the shelf is flexible to allow insertion of the bracket beyond the tab. Additionally, secondary engagement means is provided between the lower edge of each rib on the shelf and a support finger on the bracket after the brackets are inserted into the channels of the shelf, the brackets are firmly attached to the shelf.

17 Claims, 3 Drawing Sheets

SHELF & BRACKET HAVING SNAP-TOGETHER FIT

SUMMARY OF THE INVENTION

The present invention provides a shelf and bracket system wherein the bracket is interlocked to the shelf. It can be viewed as a "snap-together" system. It utilizes no additional hardware to attach the brackets to the shelves.

The present invention provides detents on the shelf which cooperate with recesses in the brackets to locate the bracket with respect to the shelf and lock the bracket to the shelf. The detent is on a flexible member of the shelf whereby the bracket can be inserted beyond the detent and then restrained from withdrawing from the detent. A channel is provided in the shelf for receiving the bracket. In addition, laterally transverse ribs are provided in the shelf to strengthen the shelf and provide an interlocking means between the bottom of the ribs and the brackets, thereby further securing the brackets to the shelf and vice versa. Additionally, the shelf is provided with a forwardly sloping nose panel, and that nose portion is supported with a support member on the bracket. The shelf can be formed from a single piece of sheet metal which is unitary and of uniform thickness. Each bracket can be formed from a single piece of sheet metal, which is unitary and of a uniform thickness. The shelves and brackets can be painted or otherwise coated either before or after being formed and punched.

The present invention provides a shelf and bracket assembly wherein the bracket is attached to a wall standard, i.e., a support member which is mounted on the wall. The shelf has a channel formed along each of its lateral edges and the channel is downwardly opening. The channel extends from the front to the back of the shelf and is for receiving the bracket. The bracket has a width which is narrower than the normal width of a channel, whereby the bracket fits within the channel and extends from the front to the back of the shelf. An interference means is provided within the channel for positioning and retaining the bracket within the channel. The interference means as described is a tab on the side apron of the shelf and the web material on the bracket which is located between the notch and the upper edge of the bracket.

The present invention further provides a shelf and bracket assembly wherein the bracket is attachable to a support member fastened to a wall, and the shelf has a channel which opens downwardly and extends from the front to the back of the shelf. The bracket has a portion which cooperates with the channel. The thickness of the bracket is narrower than the normal width of the channel, such that the bracket will fit within the channel. The channel has vertical side walls. One of the side walls is flexible whereby that side wall can be temporarily moved outwardly to widen the channel and allow passage of the bracket into the channel. The sidewall of the channel has a tab which is inwardly facing and falls within the channel. The bracket has a notch below its upper edge, leaving a web of material between the notch and the upper edge of the bracket. The notch is aligned with the tab so as to cooperate with the tab and form a detent; i.e., the tab becomes registered in the notch. A transverse rib extends from one lateral edge to the other lateral edge of the shelf. The rib extends downwardly from the top surface of the shelf and is perpendicular to the channel. A nose portion is provided on the shelf. The nose portion extends forwardly and downwardly from the top surface of the shelf. A re-entrant portion extends from the lower edge of the nose rearwardly to form a convex exterior portion of the front of the shelf and a concave interior portion on the front of the shelf. Additionally, a slot is provided on the lower edge of the rib and a finger is provided on the side of the bracket, the slot and finger being engaging and cooperating.

The present invention further provides a shelf being formed and folded from a single piece of shelf material. The shelf has a top portion, a right hand flange or apron which depends from the top portion, a left hand flange or apron depending from the top portion, and a transverse rib which depends from the top portion. The right hand flange is based from one end of the rib and forms the first channel along one lateral edge of the shelf. The left hand flange is based from the other end of the rib and forms a second channel along the other lateral edge of the shelf. An interference means is located within each channel and may be a tab or other member extending into the channel.

The present invention provides further advantages which will be apparent to those of ordinary skill in the art.

BRIEF DESCRIPTION OF THE DRAWINGS

The drawings are as follows. They illustrate a preferred embodiment of the invention.

DETAILED DESCRIPTION OF THE INVENTION

Figure 1:
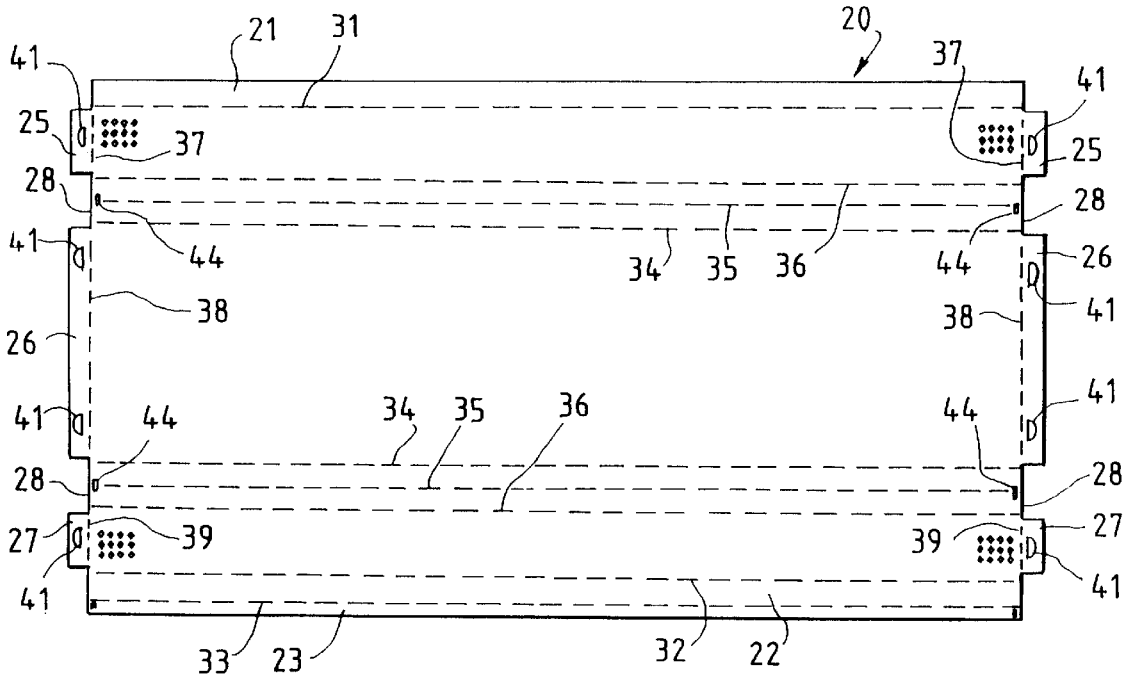
FIG. 1 is a plan view of the sheet metal from which the shelf is formed, prior to the sheet metal being folded.
Figure 2:
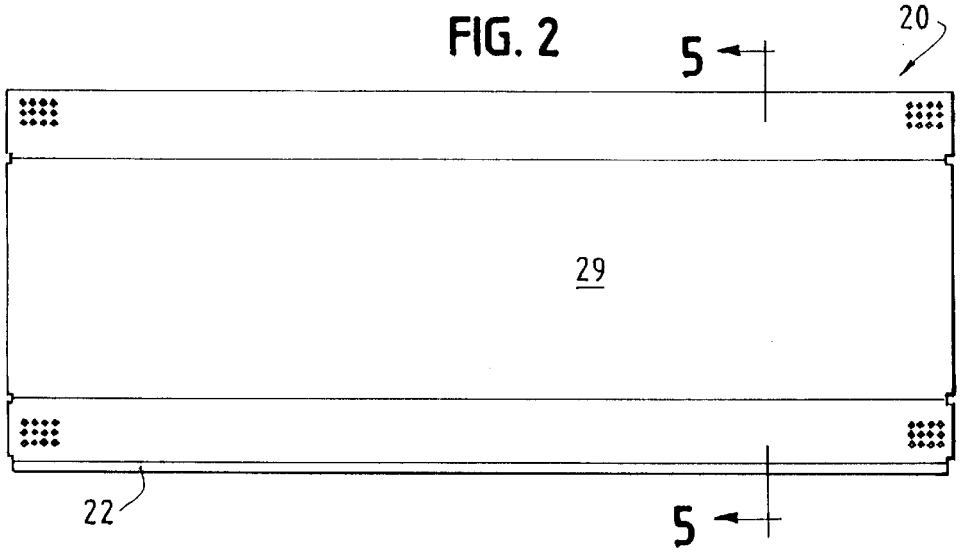
FIG. 2 is a plan view of the shelf after it is creased and folded.
Figure 3:
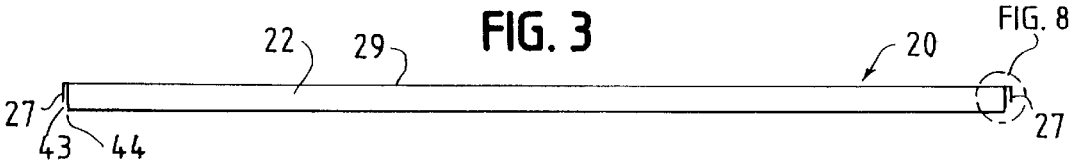
FIG. 3 is a front elevation view of the shelf shown in FIG. 2.
Figure 4:
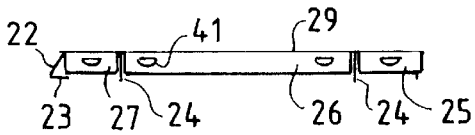
FIG. 4 is a side elevation view of the shelf shown in FIG. 2, as viewed on the right hand side of FIG. 2.
Figure 5:
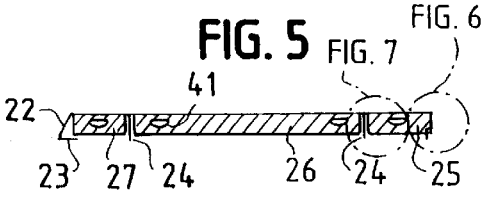
FIG. 5 is a cross section view taken along line A—A as shown in FIG. 2.
Figure 9:
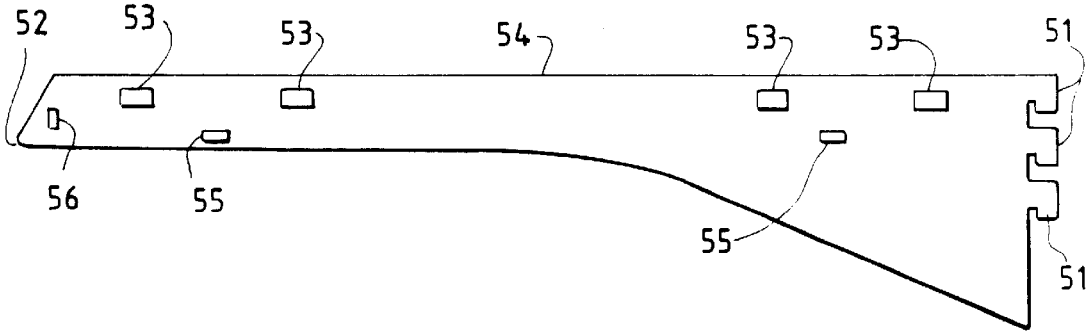
FIG. 9 is a side elevational view of the bracket of the invention.
Figure 10:
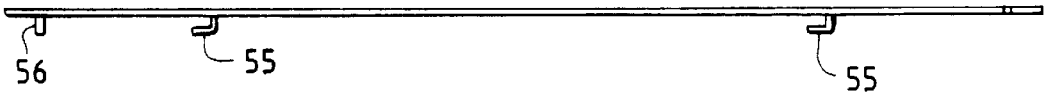
FIG. 10 is a top view of the bracket of the invention.
Figure 11:
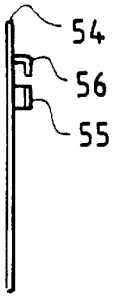
FIG. 11 is a front view (as viewed from the left hand side of FIG. 9) of the bracket of this invention.

The present invention provides a shelf system comprising a shelf 20 shown generally in FIGS. 1 and 2 and a bracket 50 shown generally in FIGS. 9, 10 and 11. The shelf and bracket are manufactured separately and snapped together to become a cohesive unit through a plurality of tabs 41 on the shelf which fit into notches 53 on the brackets, and notches 44 on the shelf which cooperate with fingers 55 on the bracket. The brackets shown are typical bayonet-type brackets which fit into and interlock with vertical standards which are attached to a wall, the vertical standards are well known in the shelving industry.

The shelf 20 in the preferred embodiment is constructed from sheet metal, having a plan form as shown in FIG. 1. The sheet metal is then folded on the dashed lines shown in FIG. 1 to form the shelf as shown in FIG. 2. The material for the shelf in the preferred embodiment has a thickness of about 0.030 inches and can be cold rolled sheet steel such as B45–60. It can be electrogalvanized and further painted to provide a finish if desired.

The shelf shown in FIG. 1 is folded along the dashed lines to form the shelf as shown in FIG. 2. The rear apron 21 is formed by folding along rear apron fold line 31. The nose 22 of the shelf is formed by folding along nose fold line 32. The re-entrant portion 23 of the nose is formed by folding along re-entrant fold line 33. Ribs 24 are formed by folding along rib fold lines 34, 35 and 36. Side aprons 25, 26 and 27 are formed along each lateral edge by folding along fold lines 37, 38 and 39. Side aprons 25, 26 and 27 may also be referred to as flanges and have a slight gap between them in the preferred embodiment.

A tab 41, sometimes referred to as a louver, is formed in each of the side aprons. It is formed by piercing the medal and extending the tab inwardly from the plane of the side aprons. A tab 41 is formed in each side apron 25, 26 and 27. The tabs 41 lie within the channel 43 which is formed between the side aprons 25, 26 and 27 and the end of the rib 24 as more clearly shown in FIG. 8. Each tab 41 cooperates with a notch 53 or hole in the bracket, as will be further explained later. The tab 41 and notch 53 cooperate to form an interference means between the shelf and bracket so that the shelf and bracket are attached together.

Figure 7:
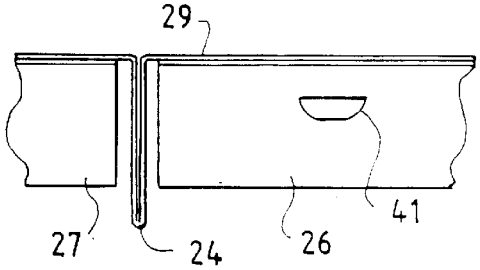
FIG. 7 is an enlarged view of the portion of the shelf shown at C in FIG. 5.

The shelf is also provided with notches 44, which also cooperate with an element, finger 55, on the bracket. The notches 44 and fingers cooperate to form one type of engagement means for providing additional positioning of the shelf on the bracket. The notch 44 is formed in the lower edge of the rib 24 as is shown most clearly in FIG. 8. A notch 44 is adjacent each end of each rib, it being noted that the shelf as shown has two ribs 24, each of which extend from side to side on the shelf. Due to the folding of the sheet metal, the ribs are a double thickness as shown in FIG. 7 with the two thicknesses being continuous around the radius at the bottom of the rib and the two thicknesses being closely adjacent to each other at the top of the rib.

Figure 8:
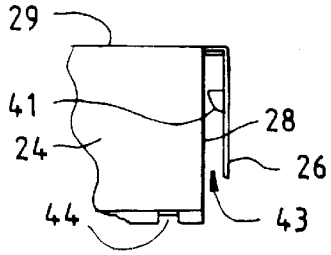
FIG. 8 is an enlarged view of the end of the shelf indicated at D in FIG. 3.

The channel 43 has two vertical side walls as indicated in FIG. 8. One of the vertical side walls is provided by the inner edge of side apron 26 and the inner edges of the other side aprons 25 and 27. The other vertical side wall of the channel 43 is provided by the lateral edges 28 of the ribs 24.

The tabs 41 may have approximate dimensions of 3/16 inches high, 33/64 inches wide and being located approximately 9/32 inches below the top surface of the shelf. The finished shelf of the preferred embodiment has overall dimensions of about 48 inches side to side and 18 ½ inches front to rear. The rear portion of the shelf (i.e., between the rear apron and the rear rib) is approximately 3 5/16 inches. The center portion of the shelf (i.e., the portion between the two ribs) is approximately 11 21/32 inches front to back, and the front portion of the shelf (that portion between the front rib and the nose) is about 2 ⅞ inches. The nose panel 22 slopes forwardly and downwardly to a location 1 ¼ inches below the top surface of the shelf and 25/32 inches forward of the front portion of the shelf. The re-entrant portion 23 extends approximately 1 inch from the nose portion. The ribs 24 are approximately 1 5/16 inches high and the two thicknesses forming each rib are not in contact, the gap between the two thicknesses being approximately 1/16 inches at the bottom and 1/64 inch at the top. Thus the bent sheet metal forming the bottom of each rib provides a flexing means between the two portions of each rib and between the middle portion of the shelf and respectively the front portion and the rear portion of the shelf.

The tab 41 extends approximately ⅛ inch into the channel 43. The channel has a nominal width of 5/32 inches. Thus, the tab 41 is about 80 percent of the channel width in the preferred embodiment and should be at least 50 percent of the channel width. The tab in the rear-most side apron 25 is located approximately 1 7/32 inches forward of the rear edge of the shelf. The tab 41 located in the forward most side apron 27 is approximately 1 ½ inches forward from the forward rib. The two tabs 41 in the middle side apron 26 are each located approximately 1 ½ inches away from its adjacent rib.

The notches 44 adjacent to each end of ribs 24 are approximately 5/16 inches high, or deep, and 5/32 inches wide. Each slot is located approximately 3/16 inches inwardly from the lateral edge of the rib. The top surface of the shelf is indicated by 29.

Figure 6:
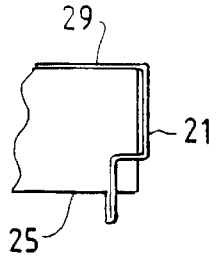
FIG. 6 is an enlarged view of the end of the shelf indicated at B in FIG. 5.

Detail of the rear apron of the shelf is shown in FIG. 6. The rear apron 21 depends from the top surface 29 and may preferably be bent as shown in a "Z" fashion to provide additional strength to the rear apron. The rear apron is approximately 1 ¼ inches high overall, wherein the top portion is ¾ inch and the bottom portion is ½ inch. The offset is approximately 7/32 inch and the rear apron 21 extends approximately ¼ inch below side apron 25.

The bracket 50 is generally shown in FIGS. 9–11. It is a cantilever-type bracket having bayonet interlocking members 51 located at the rear of the bracket. These locking members cooperate with slots on vertical mounting channels (not shown) which are well known in the art. The nose 52 of the bracket is configured similar to the nose 22 of the shelf. The bracket has four notches 53, sometimes referred to as holes, located slightly below its upper edge 54. The notches 53 are positioned to cooperate with the tabs 41 on the shelf. The bracket also has fingers 55 projecting out of the plane of the bracket. These fingers are punched out from the main body of the bracket. The fingers 55 cooperate with the notch 44 on the shelf and are located accordingly. Also provided is a nose support 56 which cooperates with the underside of the nose 22 of the shelf. The nose support 56 is punched or lanced from the body of the bracket.

The notches 53 are approximately ¼ inch below the upper edge 54 of the bracket; they are approximately 5/16 inch by ⅝ inch. The fingers 55 are located approximately 1 3/64 inches below the upper edge of the bracket. They protrude from the plane of the bracket about ¼ inch. They are ⅜ inch long and ¼ inch high. The nose support 56 is ⅝ inch below the upper edge 54 of the bracket and 9/16 inch rearward from the foremost portion of the bracket. It extends approximately ¼ inch from the plane of the bracket and is about ¼ inch high. The bracket can be made from 11 gauge material, which may be ASTM A-570 grade 50, structural quality steel.

Figure 12:
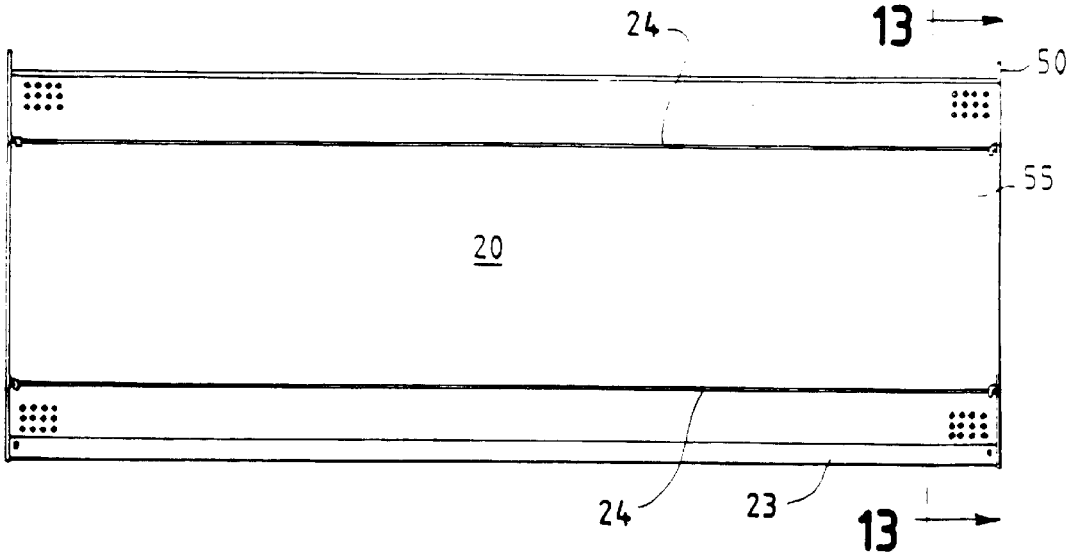
FIG. 12 is a bottom view of the shelf and bracket assembled.
Figure 13:
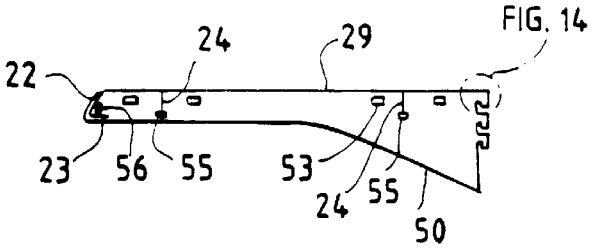
FIG. 13 is an elevation cross-section view taken along line B—B of FIG. 12.
Figure 14:
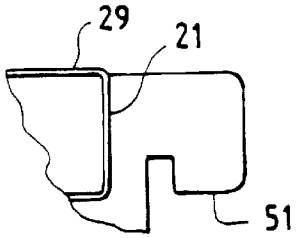
FIG. 14 is an enlarged view of the portion at the corner indicated at F in FIG. 13.

FIGS. 12–14 show the brackets 50 assembled within the channels 43 of the shelf 20. There is one bracket 50 at each lateral edge of the shelf. The bracket is inserted in the channel 43, forcing the side aprons outwardly to allow passage of the bracket beyond the tabs 41. When the notches 53 of the bracket register with the tabs 41 of the shelf, the side aprons 25, 26 and 27 move back to their normal position and lock the bracket within the channel. The tabs 41 act as detents, failing within the notches 53 of the bracket.

Coincidentally, the notches 44 on the lower edge of the ribs register with the fingers 55 on the bracket whereby the fingers 55 are located within the notches 44 as shown in FIG. 13. The flexing of the side aprons 25, 26 and 27 at their connection to the top surface 29 of the shelf, which is the proximal edge of the sidewall, allows the temporary widening of the channel to allow the bracket to slide past the tabs 41. The elasticity of the shelf material returns the side aprons to their normal or original position when the notches 53 align with the tabs 41. The nose 22 of the shelf lies on the nose support 56 on the bracket, providing support for the forward portion of the shelf. The re-entrant portion 23 of the shelf extends rearwardly underneath the support 56 on the bracket, as shown in FIG. 13.

A prefer red embodiment of the invention has been described by way of example only. It will be apparent to those skilled in the art that certain modifications and adaptations may be made without departing from the scope of the invention, as set out in the claims below.

I claim:

1. A shelf and bracket assembly, the bracket being attachable to a support member, the assembly comprising:

a. a shelf having a channel, the channel extending from the front to the back of the shelf, the channel being for receiving the bracket, wherein the channel further comprises a flexing means and has two vertical sidewalls attached thereto, the flexing means connecting one of said sidewalls at its proximal edge to the shelf, said flexing means allowing the one of said sidewalls to flex at its distal edge to allow temporary widening of the channel;

b. a bracket having a width narrower than the nominal width of the channel, whereby the bracket fits within the channel, the bracket extending from the front to the back of the shelf;

c. an interference means formed within the channel by the shelf and the bracket, said interference means for positioning and retaining the bracket within the channel, the interference means comprising 1) a detent attached to one of said sidewalls and extending into the channel a distance greater than a predetermined clearance between the channel width and a predetermined width of the bracket which mates with said channel; and 2) a notch in the bracket, the notch being in alignment with and cooperating with the detent;

whereby, as the bracket is inserted into the channel, the bracket engages said detent and exerts a force on the detent and flexes said one sidewall attached to said flexing means and widens said channel by interaction of the bracket with the detent, thereby allowing the bracket to be inserted beyond the detent and allowing the detent to become located within the notch in the bracket, whereby the shelf is positioned with and attached to and supported by the bracket.

2. The assembly of claim 1 wherein the channel opens downwardly.

3. The assembly of claim 1 wherein the shelf includes a top surface and a transverse rib, the rib extending downwardly from the top surface of the shelf, and the rib being perpendicular to the channel.

4. The assembly of claim 1 wherein the shelf includes a nose portion at a forward margin of the shelf, the nose portion having a rearward facing area which is concave, and the bracket includes a forward portion, the forward portion being configured similarly to the concave portion.

5. The assembly of claim 4 wherein the nose portion has a first section which extends forwardly and downwardly and a second section which extends rearwardly.

6. The assembly of claim 5 wherein the nose portion contacts the forward portion of the bracket, and the nose portion is supported by the bracket.

7. The assembly of claim 1 which includes an engagement means formed between the shelf and the bracket when the shelf and bracket are attached to each other, said engagement means for positioning and retaining the bracket within the channel of the shelf.

8. The assembly of claim 7 wherein the engagement means includes a notch in a lower edge of the rib and a finger on the bracket, the notch being located adjacent the channel, the finger being configured to fit within and cooperate with the notch, the finger projecting outwardly from the bracket to the location of the notch.

9. A shelf and bracket assembly, the bracket being attachable to a support member, the assembly comprising:

a. a shelf having a channel, the channel extending from the front to the back of the shelf, the channel opening downwardly, the channel having vertical sidewalls, the channel adapted for receiving the bracket;

b. a bracket having a channel-mating portion which is narrower than the nominal width of the channel, whereby the bracket fits within the channel and extends from the front to the back of the shelf;

c. connecting means for connecting one of the sidewalls at a proximal edge of said one sidewall to the channel, the connecting means allowing said one of the sidewalls to flex at its distal edge, to allow temporary widening of the channel;

d. a tab on one of the channel sidewalls, the tab extending outwardly from a plane of the sidewall and into the channel;

e. an aperture in the bracket, the aperture being in alignment with and cooperating with the tab in the channel;

f. a transverse rib, the rib extending downwardly from a top surface of the shelf, the rib being perpendicular to the channel;

g. a nose portion on the shelf at its forward margin, the nose portion has a first section and a second section, the first section extends forwardly and downwardly from the top surface of the shelf, the second section extends rearwardly from the first section; and h. an engagement means for positioning and retaining the bracket within the channel, the engagement means includes a notch in a lower edge of the rib and a finger on the bracket, the notch being located adjacent the channel, the finger being configured to fit within and cooperate with the slot, the finger projecting outwardly from the bracket to the location of the notch;

whereby the bracket and shelf are positioned and locked together when the bracket is inserted into the channel.

10. A shelf, the shelf being formed and folded from a single piece of shelf material, the shelf comprising:

a. a top portion;

b. a right hand flange depending from the top portion;

c. a left hand flange depending from the top portion;

d. a transverse rib depending from the top portion, the rib being perpendicular to the right hand flange and the left hand flange;

e. the right hand flange spaced from one end of the rib, thereby forming a first channel, and the left hand flange spaced from the other end of the rib, thereby forming a second channel;

f. an interference means being located and extending within each channel and for engaging a cooperating member; and g. a nose portion, the nose portion extends forwardly from the top portion and has a first and second section, the first section extends forward and downward to a proximal position, and the second section extends rearward from the proximal position.

11. The shelf of claim 10 and including an engagement means being located on the rib, said engagement means being for engaging a complementary and cooperating support member.

12. The shelf of claim 11 wherein the engagement means is a slot in the lower edge of the rib and is located adjacent to each channel.

13. The shelf of claim 10 wherein the interference means is a tab extending from each said flange and into the respective channel.

14. A shelf formed of a shelf material, said shelf comprising:

a. a top portion;

b. a right hand flange depending from a right hand edge of the top portion, said flange being flexible with respect to the top portion;

c. a left hand flange depending from a left hand edge of the top portion, said flange being flexible with respect to the top portion;

d. a transverse rib depending from the top portion, the rib being perpendicular to the right hand flange and the left hand flange, the rib being located rearward from a front edge of the shelf and forward from a rear edge of the shelf, the rib being a portion of the shelf material which is folded back on itself to form a double thickness;

e. the right hand flange spaced from one end of the rib, thereby forming a first channel between one end of the rib and an inside surface of the right hand flange, and the left hand flange spaced from the other end of the rib, thereby forming a second channel between the other end of the rib and an inside surface of the left hand flange;

f. a tab extending from each said flange and into the respective channel, said tab extending a distance greater than fifty percent of the width of each channel; and g. a slot in the lower edge of the rib, said slot being located adjacent each channel.

15. The shelf of claim 14 including detent means located and extending within each channel, said means for engaging a cooperating support member.

16. The shelf of claim 15 wherein the detent means comprises:

a. a fight-hand tab attached to the right-hand flange and extending toward the left from the flange; and b. a left-hand tab attached to the left-hand flange and extending toward the right from the flange.

17. The shelf of claim 14 including the following:

a. a right-hand end of each of the back flange and the rib and the front flange being spaced equally from the right-hand flange, whereby the width of the right-hand channel is the same at said back, front and right-hand flanges; and b. the left-hand end of each of the back flange and the rib and the front flange being spaced equally from a left-hand flange, whereby the width of the left-hand channel is the same at said back, front and left-hand flanges.

* * * * *

UNITED STATES PATENT AND TRADEMARK OFFICE

CERTIFICATE OF CORRECTION

PATENT NO. : 6,520,353 B2
DATED : February 18, 2003
INVENTOR(S) : Eric A. Fulbright It is certified that error appears in the above-identified patent and that said Letters Patent is hereby corrected as shown below:

Column 8,
Line 17, change “fight-hand” to -- right-hand --

Signed and Sealed this

Thirteenth Day of April, 2004

JON W. DUDAS
*Acting Director of the United States Patent and Trademark Office*